United States Patent [19]

Grah et al.

[11] Patent Number: 4,588,973

[45] Date of Patent: May 13, 1986

[54] COIL BOBBIN HAVING NOVEL MEANS FOR TERMINATING FINE WIRES

[75] Inventors: Neil E. Grah, Fairland; Albert C. Bannon, Indianapolis, both of Ind.

[73] Assignee: Emhart Industries, Inc., Indianapolis, Ind.

[21] Appl. No.: 794,262

[22] Filed: Nov. 1, 1985

Related U.S. Application Data

[63] Continuation of Ser. No. 527,242, Aug. 29, 1983, abandoned, which is a continuation of Ser. No. 288,672, Jul. 30, 1981, abandoned.

[51] Int. Cl.[4] ..... H01F 15/10

[52] U.S. Cl. ..... 336/192; 336/208

[58] Field of Search ..... 336/192, 208, 198; 310/71

[56] References Cited

U.S. PATENT DOCUMENTS

| | | | |
|---|---|---|---|
| 3,265,999 | 8/1966 | Kessel | 336/192 |
| 3,566,322 | 2/1971 | Honbach | 336/198 X |
| 4,334,208 | 6/1982 | Post | 336/192 |
| 4,347,493 | 8/1982 | Adams et al. | 336/192 |

FOREIGN PATENT DOCUMENTS

| | | | |
|---|---|---|---|
| 1272454 | 7/1968 | Fed. Rep. of Germany | 336/198 |
| 1243690 | 8/1971 | United Kingdom | 336/208 |

*Primary Examiner*—Thomas J. Kozma

*Attorney, Agent, or Firm*—Robert F. Meyer

[57] ABSTRACT

A slit is provided in a flange of a coil bobbin and is adapted to receive electrical terminals after ends of a wire have been wound on the terminals.

3 Claims, 4 Drawing Figures

COIL BOBBIN HAVING NOVEL MEANS FOR TERMINATING FINE WIRES

This application is a continuation of application Ser. No. 06/527,242, filed 8/29/83, now abandoned, which is a continuation of application Ser. No. 288,672, filed 7/30/81, now abandoned.

BACKGROUND OF THE INVENTION

Generally speaking, the present invention pertains to a coil bobbin which comprises a cylinder having an outer surface upon which wire may be wound; oppositely disposed flanges extending outwardly from opposed ends of the cylinder to provide an annulus receiving the wire; a housing carried on one of the flanges; a slit disposed within the one flange extending along a perimeter thereof beneath and at least to opposed sides of the housing; a pair of apertures in a base of the housing extending through the one flange to the slit; and a pair of exits from the slit to the annulus, one at an end of the slit and the other beneath the housing.

The present invention pertains to a coil bobbin and more particularly to a coil bobbin having a means for terminating the ends of wire wound on the bobbin.

The termination of small magnet wire has presented numerous difficulties largely because of the fineness and the inherent frailties of the wire. Particularly troublesome are the very small gauge magnet wires employed on coils employed in small synchronous motors used in appliance timers. Not only are the wires difficult to handle but there must also be a means to terminate the wires in a manner that provides good electrical insulation. One such method utilized a tape over the electrical connection. Such a method was at best somewhat unreliable and in addition added fabrication difficulties. The present invention, therefore, is directed to a coil bobbin having improved means to terminate the ends of the wire carried by the bobbin.

OBJECTS OR FEATURES OF THE INVENTION

It is, therefore, a feature of the invention to provide a coil bobbin having a means to terminate the ends of a wire carried by the bobbin. Another feature of the invention is to provide such a coil bobbin wherein the means to terminate the wires effectively provides good electrical insulation. Another feature of the invention is to provide such a coil bobbin having a cylinder for carrying the wire, oppositely disposed flanges extending from the cylinder and a slit within one of the flanges for receiving electrical terminals carried by the bobbin. Still another feature of the invention is to provide such a coil bobbin wherein the slit is disposed beneath a housing for the electrical terminals and carried on the flange containing the slit. Yet another feature of the invention is to provide such a coil bobbin wherein there is a pair of exits from the slit to the wire carried by the bobbin. These and other features of the invention will become apparent from the following description taken in conjunction with the accompanying drawings.

DETAILED DESCRIPTION OF THE INVENTION

Figure 1:
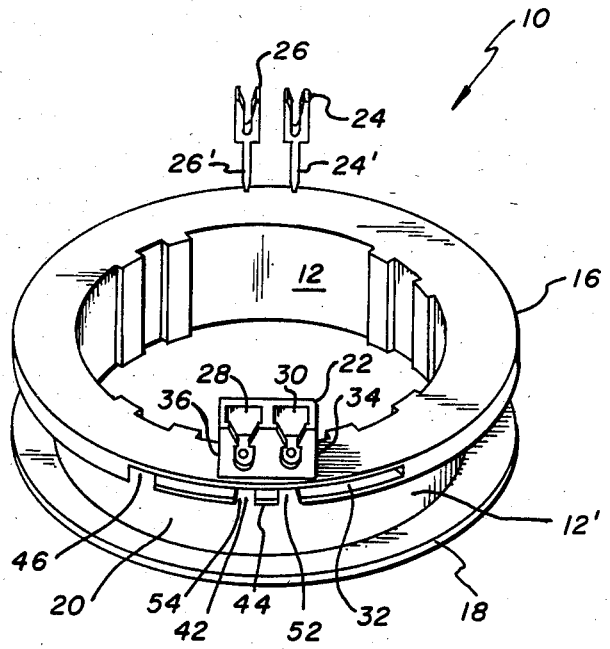
FIG. 1 is a view showing a complete coil bobbin employing the features of the invention.

Referring now to the drawings, there is shown a coil bobbin 10 which includes a cylinder 12 having an outer surface 12' upon which a coil of wire 14 may be wound. The bobbin is fabricated from an electrically insulative material such as a suitable plastic. Flanges 16 and 18 extend outwardly from opposed ends of the cylinder to provide an annulus 20 for carrying the wire 14. A housing 22 is carried on one of the flanges to receive a pair of electrical terminals 24 and 26, each of the terminals being carried in separate compartments 28 and 30 of the housing.

In accordance with the invention, a slit 32 is provided in flange 16 which extends along a perimeter of the flange beneath the housing 22 to at least the opposed sides 34 and 36 of the housing. A pair of apertures 38 and 40 extend through the base of the housing and through an exit 42, the flange 16 to open to the annulus 20. As shown, a partition 44 separates exit 42 into two separate openings 52 and 54. As can be clearly seen in FIG. 2, terminals 24 and 26 extend from housing 22 through the apertures 38 and 40 and through the slit 32 to the annulus 20. There is another exit 46 at the end of the slit 32.

Figure 2:
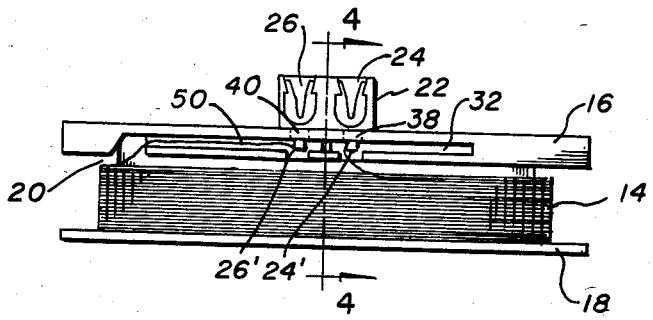
FIG. 2 is a view showing the bobbin with wire wound on the bobbin.
Figure 4:
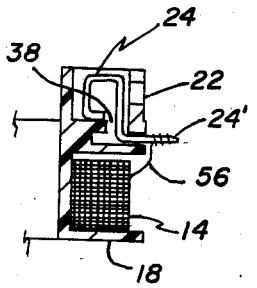
FIG. 4 is a section taken along the line 4—4 of FIG. 2.
Figure 3:
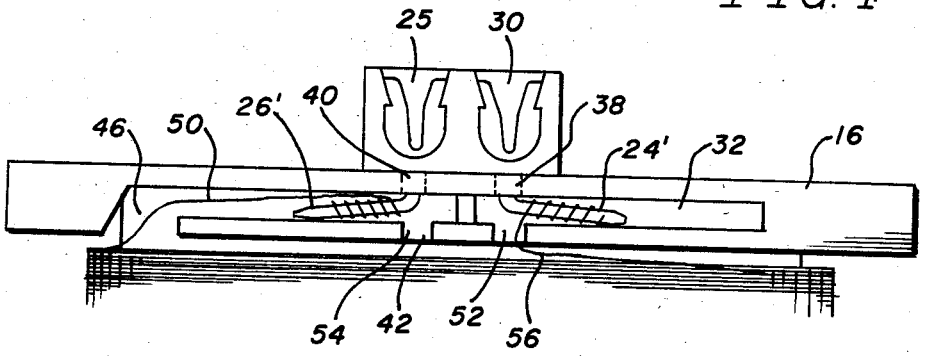
FIG. 3 is an enlarged view of a portion of the bobbin of FIG. 2 showing the means to terminate and electrically insulate the wire terminations.

To wind the wire on the bobbin and terminate its ends in accordance with the invention, the terminals 24 and 26 are inserted into their respective compartments of housing 22 with the ends 24' and 26' of the terminals being extended through apertures 38 and 40 of the flange and through openings 52 and 54 and then, as shown in FIGS. 2 and 4, the ends of the terminals are bent up to be substantially normal to the axis of the bobbin. The wire is then wound on the bobbin by first attaching the start end 50 of the wire first being wound on the end 26' of the terminals and finally the finish end being wound on terminal 24'. As shown in FIG. 3, the terminals are then bent over and fitted into the slit 32 with the start end 50 being fed out exit 46 and the finish end 56 being fed through opening 52. Apertures 38 and 40 are of sufficient size to permit the terminals ends 24' and 26' to be twisted and bent into the slit without breakage. The wire has now been completely wound on the bobbin and its ends electrically insulated from each other.

What is claimed is:

1. A coil bobbin, comprising a cylinder having an outer surface upon which wire may be wound; oppositely disposed flanges extending outwardly from opposed ends of said cylinder providing an annulus for receiving said wire; a housing carried on one of said flanges; a slit disposed within said one flange extending along a perimeter thereof beneath and at least to opposed sides of said housing; a pair of apertures in a base of said housing extending through said one flange to said slit; a pair of exits from said slit to said annulus, one at an end of said slit, the other beneath said housing in line with said pair of apertures; and a partition extending within and across a width of said slit between said pair of apertures and into said exit beneath said housing.

2. A coil bobbin according to claim 1 wherein said pair of apertures is of sufficient size to permit bending of said wire into said slit.

3. A coil bobbin according to claim 1 wherein said housing is compartmentalized corresponding to said pair of apertures.

* * * * *